US007683263B2

(12) United States Patent
Chiang

(10) Patent No.: US 7,683,263 B2
(45) Date of Patent: Mar. 23, 2010

(54) FLAT CABLE COVERING MEANS FOR GENERATING DIFFERENT IMPENDANCES

(75) Inventor: Chin-Chih Chiang, Taipei (TW)

(73) Assignee: Jess-Link Products Co., Ltd., Taipei (TW)

( * ) Notice: Subject to any disclaimer, the term of this patent is extended or adjusted under 35 U.S.C. 154(b) by 150 days.

(21) Appl. No.: 12/014,166

(22) Filed: Jan. 15, 2008

(65) Prior Publication Data

US 2009/0035600 A1 Feb. 5, 2009

(30) Foreign Application Priority Data

Aug. 1, 2007 (TW) ..... 96212607 U

(51) Int. Cl.
*H01B 7/08* (2006.01)

(52) U.S. Cl. ..... 174/117 F

(58) Field of Classification Search ..... 174/117 F, 174/117 FF, 36

See application file for complete search history.

(56) References Cited

U.S. PATENT DOCUMENTS 5,097,099 A * 3/1992 Miller ..... 174/36
5,554,825 A * 9/1996 Parker et al. ..... 174/117 F

* cited by examiner

*Primary Examiner*—Chau N Nguyen
(74) *Attorney, Agent, or Firm*—Chun-Ming Shih

(57) ABSTRACT

A flat cable covering means for generating different impedances includes a plurality of cores, an insulating body and a first metallic covering layer. The cores are arranged at an interval respectively. The insulating body covers an outer surface of the cores. The first metallic covering layer is provided to correspond to a portion of cores and partially covers one side of the insulating body with the impedance of the cores in an area covered by the first metallic covering layer smaller than that of the cores in an area not covered by the first metallic covering layer. Via this arrangement, in order to correspond to the need of impedances of different devices in the electronic apparatus, the different impedances can be made integrally in the same flat cable. In this way, not only the manufacturing and assembling processes can be simplified, but also the management and layout of lines are simple and convenient.

5 Claims, 4 Drawing Sheets

FLAT CABLE COVERING MEANS FOR GENERATING DIFFERENT IMPENDANCES

BACKGROUND OF THE INVENTION

1. Field of the Invention

The present invention relates to a flat cable covering means, and in particular to a flat cable covering means for generating different impedances.

2. Description of Prior Art

Since electronic apparatuses are getting more and more precise, the structure of a computer or television also becomes much more delicate. Thus, a flat cable is applied in the above electronic apparatus to transmit signals, so that the manufacturer or user can attach the flat cable to a connector rapidly. With a row-like structure of the flat cable, the arrangement within the space of the computer or television is neat and clear so as to facilitate the dissipation of the heat generated. Further, the maintenance of the electronic apparatus can be performed easily, thereby keeping a good effect of transmitting signals.

The conventional flat cable covering means is constituted of a plurality of copper cores and an insulating body made of PVC materials. The insulating body covers each core to make each core to be arranged in parallel and separated from each other in such a way that they are electrically insulated, thereby forming a flat cable covering means.

However, in practice, the conventional flat cable covering means still has some drawbacks as follows. Since a plurality of transmission lines should be made according to various kinds of devices within the electronic apparatus, and these transmission lines are connected with the connector respectively, a plurality of sets of molds should be manufactured separately in order to make flat cables of different impedances. Further, when the conventional flat cable covering means is inserted into the connector, it always takes a lot of time in assembly. In addition to the cost of mold and labor, the arrangement of transmission lines applied to different devices within the electronic apparatus becomes more complicated. Therefore, the practicability and economic benefits of the conventional flat cable covering means are reduced greatly, and thus it needs to be improved.

SUMMARY OF THE INVENTION

The present invention is to provide a flat cable covering means for generating different impedances, in which a first metallic covering layer is provided to correspond to a portion of cores. In order to correspond to the need of impedances of different devices in the electronic apparatus, the different impedances can be made integrally in the same flat cable. In this way, not only the manufacturing and assembling processes can be simplified, but also the management and layout of lines are simple and convenient.

The present invention is to provide a flat cable covering means for generating different impedances, which includes a plurality of cores, an insulating body and a first metallic covering layer. The cores are arranged at an interval respectively. The insulating body covers an outer surface of the cores. The first metallic covering layer is provided to correspond to a portion of cores and partially covers one side of the insulating body with the impedance of the cores in an area covered by the first metallic covering layer smaller than that of the cores in an area not covered by the first metallic covering layer.

DETAILED DESCRIPTION OF THE INVENTION

The detailed description and technical contents of the present invention will be explained with reference to the accompanying drawings. However, the drawings are illustrative only and are not used to limit the scope of the present invention.

Figure 1:
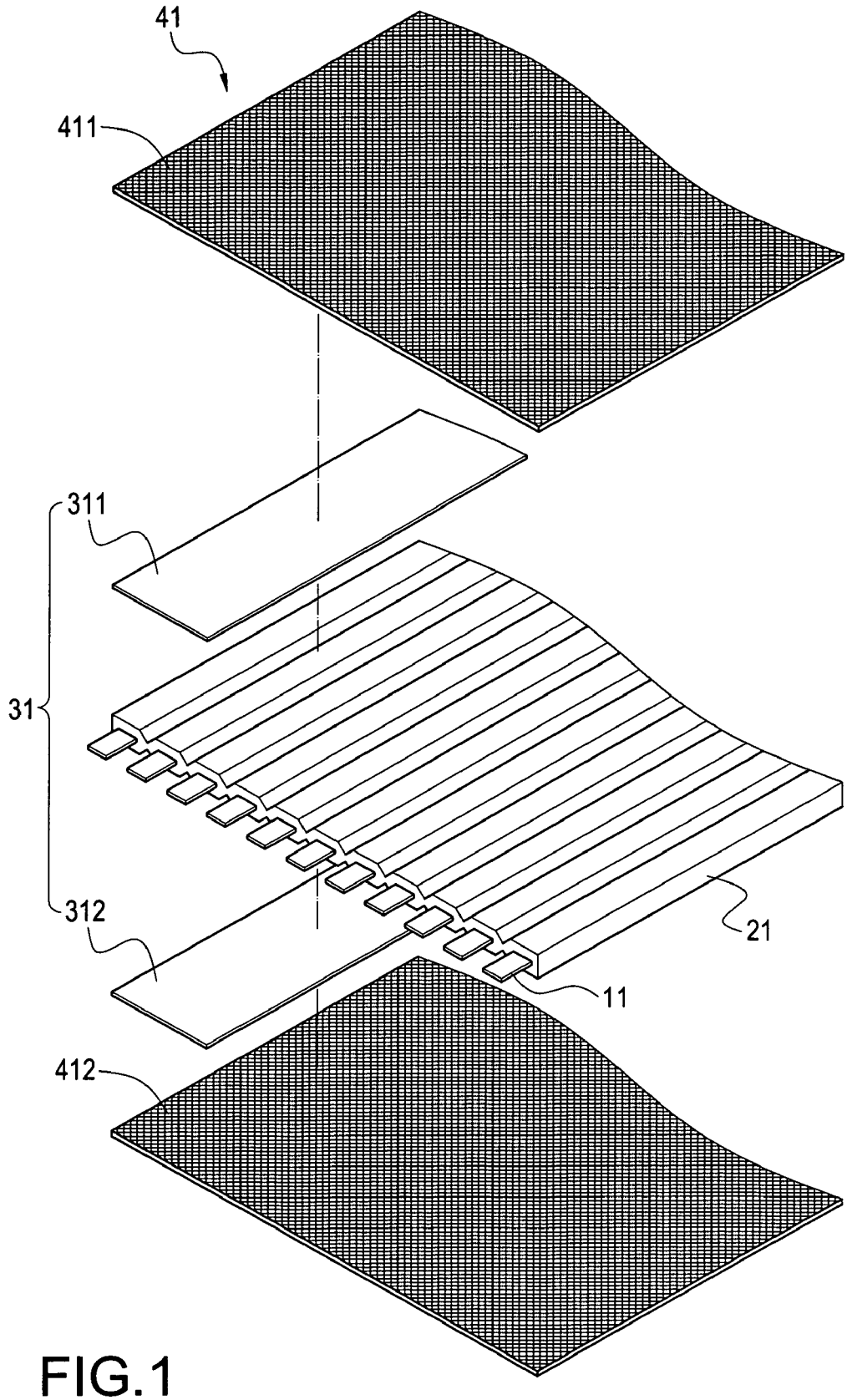
FIG. 1 is an exploded perspective view of the present invention.
Figure 2:
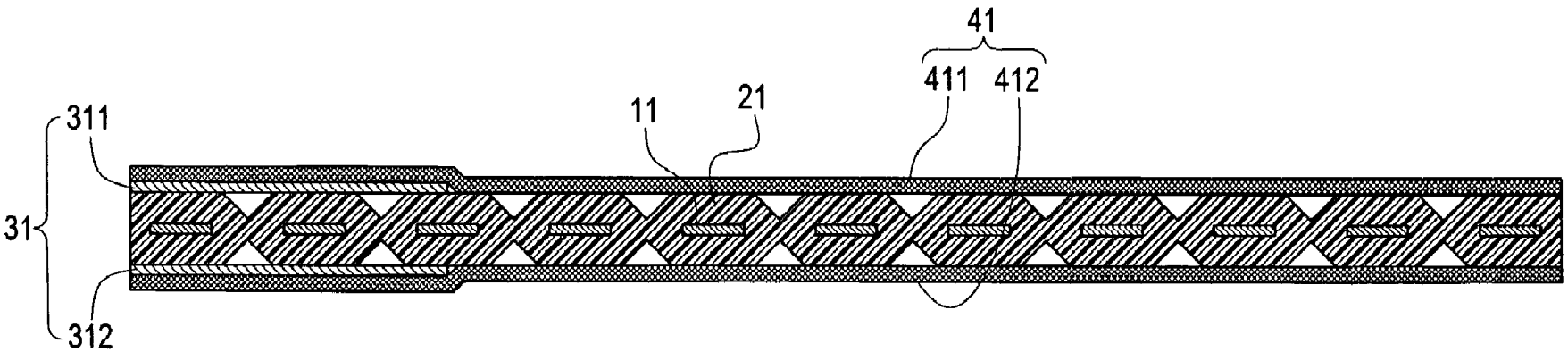
FIG. 2 is an assembled cross-sectional view of the present invention.

FIG. 1 is an exploded perspective view showing the first embodiment of the present invention, and FIG. 2 is an assembled cross-sectional view of the present invention. The present invention provides a flat cable covering means for generating different impedances, which includes a plurality of cores 11, an insulating body 21 and a first metallic covering layer 31.

The core 11 is made of metallic materials having good electric conductivity. The core can be made from single copper wire, copper piece, or copper foil, or it can be made by twisting a plurality of copper wires. The cores 11 are provided respectively at the same interval and in parallel to one another. Since the core 11 is conventional and has a large number of forms, the core is not limited to specific forms in the present invent as long as it has metallic wires for transmitting signals. Thus, the description relating to the form and structure of the core is omitted herein.

The insulating body 21 covers each core 11 by means of an injection forming or press forming process with each core 11 being separated in such a may that they are electrically insulated with each other. The insulating body 21 can be made of thermoplastic elastomer (TPE) materials. The impedance of the core 11 after being covered by the insulating body 21 is approximately 100±10Ω.

The first metallic covering layer 31 can be silver foil. In the present embodiment, the first metallic covering layer is constituted of an upper metallic covering layer 311 and a lower metallic covering layer 312 that are provided to correspond to a portion of the cores 11 on the left side and partially cover the upper and lower sides of the insulating body 21. Via the combination of the first metallic covering layer 31 with the insulating body 21, the impedance of the cores 11 in an area covered by the first metallic covering layer 31 can be reduced to 75±10Ω, which is significantly smaller than that of the cores 11 in an area not covered by the first metallic covering layer 31. The cores 11 in the area covered by the first metallic covering layer 31 can be connected to a connector (not shown), thereby transmitting video signals.

Further, the flat cable covering means of the present invention includes a second metallic covering layer 41 that is a copper web. In the present embodiment, the second metallic covering layer 41 is constituted of an upper metallic covering layer 411 and a lower metallic covering layer 412. Each of the metallic covering layers 411 and 412 covers the outer surfaces of the insulating body 21 and the first metallic covering layer 31 respectively. The electric conductivity of the second metallic covering layer 41 is smaller than that of the first metallic covering layer 31. The second metallic covering layer 41 does not affect the impedance of each core 11 significantly but it is used to protect against electron-magnetic waves.

Figure 3:
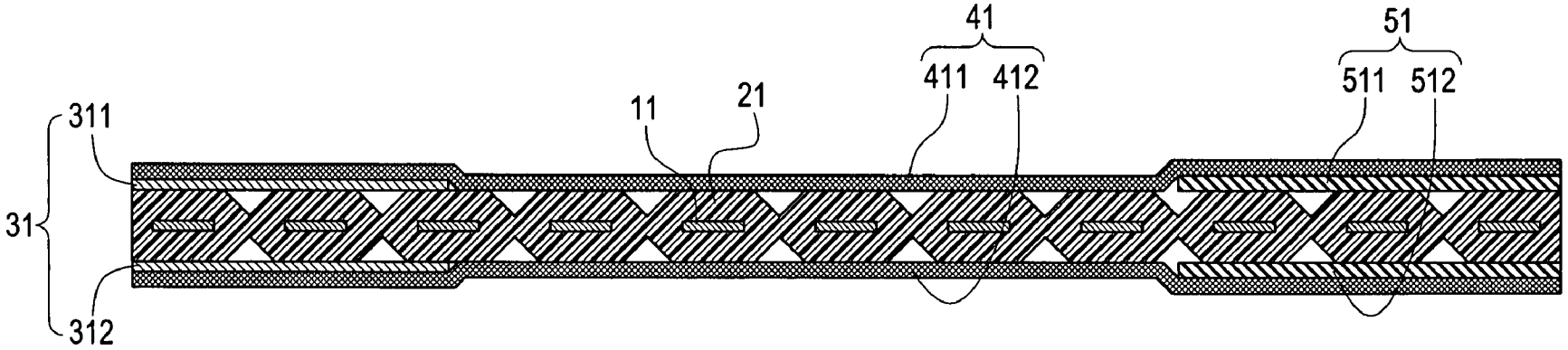
FIG. 3 is an assembled cross-sectional view showing another embodiment of the present invention.

With reference to FIG. 3, it is an assembled cross-sectional view showing another embodiment of the present invention. In addition to the previous embodiment, the flat cable covering means of the present invention further includes a third covering layer 51 that is made of polyethylene terephthalate (PET) materials. In the present embodiment, the third covering layer is constituted of an upper covering layer 511 and a lower covering layer 512. The upper covering layer 511 and the lower covering layer 512 cover one side of the insulating body 21 away from the first metallic covering layer 31 with the impedance of the cores 11 in an area covered by the third covering layer 51 being adjusted to 100±10Ω, thereby transmitting the signals of High Definition Multimedia Interference (HDMI).

Figure 4:
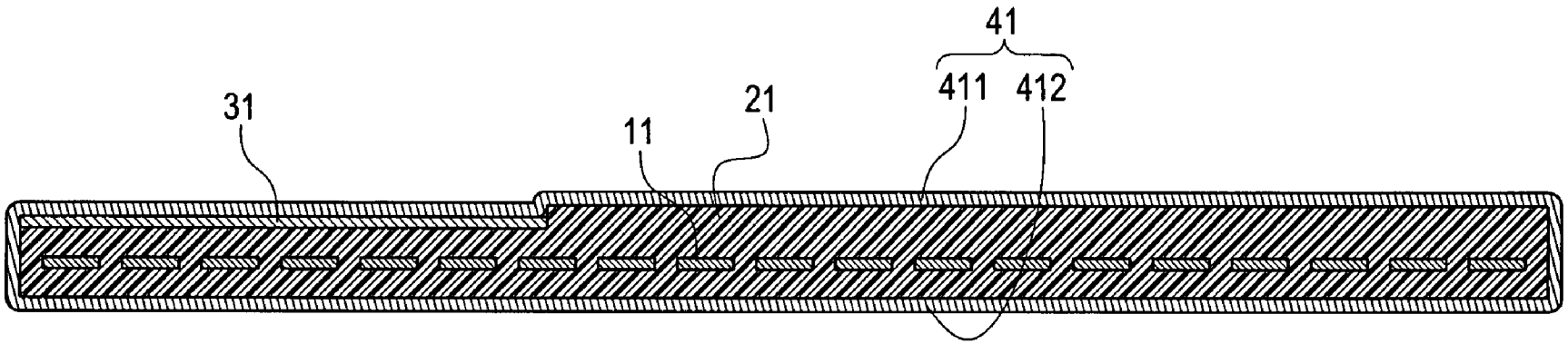
FIG. 4 is an assembled cross-sectional view showing a further embodiment of the present invention.

With reference to FIG. 4, it is an assembled cross-sectional view showing a further embodiment of the present invention. In addition to the previous embodiments in which the cores 11 are arranged respectively at the same interval and in parallel to one another, the cores can be arranged at different intervals according to practical demands. Further, a difference in height exists between the left top surface and the right top surface of the insulating body 21. The left top surface is covered by the first metallic covering layer 31 that is made of aluminum foil. The first metallic covering layer 31 and the surface of a portion of the insulating body 21 are covered by the upper metallic covering layer 411 of the second metallic covering layer 41. Further, the lower surface of the insulating body 21 is covered by the lower metallic covering layer 412 of the second metallic covering layer 41. The upper metallic covering layer 411 and the lower metallic covering layer 412 can be silver foil. Via this arrangement, the present embodiment can generate the same effect as that in the previous embodiments.

According to the above, the present invention really has industrial applicability, novelty and inventive steps. Further, the present invention has not been seen in articles of the same kind or been used in public, and thus conforms to the requirements for a utility model patent.

What is claimed is:

1. A flat cable covering means for generating different impedances, comprising:

a plurality of cores arranged at an interval between each other;

an insulating body covering an outer surface of the cores;

a first metallic covering layer provided to correspond to a portion of cores and partially covering one side of the insulating body with the impedance of the cores in an area covered by the first metallic covering layer smaller than that of the cores in an area not covered by the first metallic covering layer;

a second metallic covering layer provided to correspond to another portion of the cores and partially covering the other side of the insulating body and the first metallic covering layer; and a third covering layer, the second metallic covering layer covering an outer surface of the third covering layer, wherein the first metallic covering layer is silver foil and the second metallic covering layer is copper foil.

2. The flat cable covering means for generating different impedances according to claim 1, wherein the cores are arranged respectively at the same interval and in parallel to each another.

3. The flat cable covering means for generating different impedances according to claim 1, wherein the third covering layer is made of polyethylene terephthalate (PET) materials.

4. A flat cable covering means for generating different impedances, comprising:

a plurality of cores arranged at an interval between each other;

an insulating body covering an outer surface of the cores;

a first metallic covering layer provided to correspond to a portion of cores and partially covering one side of the insulating body with the impedance of the cores in an area covered by the first metallic covering layer smaller than that of the cores in an area not covered by the first metallic covering layer; and a second metallic covering layer covering outer surfaces of the insulating body and the first metallic covering layer;

wherein a difference in height exists between a left top surface and a right top surface of the insulating body, a top surface of smaller height is covered by the first metallic covering layer.

5. The flat cable covering means for generating different impedances according to claim 4, wherein the first metallic covering layer is aluminum foil and the second metallic covering layer is silver foil.

* * * * *